US007370391B2

(12) United States Patent
Rübenach

(10) Patent No.: US 7,370,391 B2
(45) Date of Patent: May 13, 2008

(54) DEVICE ON A SPINNING PREPARATION MACHINE, FOR EXAMPLE A TUFT FEEDER, HAVING A FEED DEVICE

(75) Inventor: Bernhard Rübenach, Mönchengladbach (DE)

(73) Assignee: Trutzschler GmbH & Co. KG, Monchengladbach (DE)

( * ) Notice: Subject to any disclaimer, the term of this patent is extended or adjusted under 35 U.S.C. 154(b) by 389 days.

(21) Appl. No.: 11/069,555

(22) Filed: Mar. 2, 2005

(65) Prior Publication Data

US 2005/0198783 A1 Sep. 15, 2005

(30) Foreign Application Priority Data

Mar. 12, 2004 (DE) ..... 10 2004 012 236

(51) Int. Cl.
*D01G 15/40* (2006.01)

(52) U.S. Cl. ..... 19/105; 19/204

(58) Field of Classification Search ..... 19/105, 19/204

See application file for complete search history.

(56) References Cited

U.S. PATENT DOCUMENTS 4,709,451 A 12/1987 Leifeld
4,731,909 A 3/1988 Duda
4,854,011 A * 8/1989 Staheli et al. ..... 19/105
4,860,406 A * 8/1989 Staheli et al. ..... 19/105
6,167,593 B1 * 1/2001 Leifeld ..... 19/97.5
6,260,239 B1 * 7/2001 Rubenach ..... 19/97.5
H2105 H * 6/2004 Pinto ..... 19/105

FOREIGN PATENT DOCUMENTS

DE 32 05 776 C3 8/1983
DE 35 35 684 C2 4/1987
DE 40 36 014 A1 5/1992
DE 199 19 447 A1 11/2000

* cited by examiner

*Primary Examiner*—Shaun R. Hurley
(74) *Attorney, Agent, or Firm*—Venable LLP; Robert Kinberg; Steven J. Schwarz

(57) ABSTRACT

A device on a spinning preparation machine, for example a tuft feeder, having a feed device comprising at least one slow-speed feed roller and a counter-element, for example a feed tray, with which fibre material can be supplied to a downstream transport device, has a driven transport element, for example a conveyor belt. In order to provide improved delivery from the feed device, or improved takeover by the downstream transport device, and to allow troublefree operation, for the purpose of determining setting values for the optimum speed of the transport element, a function between the measured values of the feed roller speed and the measured values of the transport speed is so determined that the fibre material lies on the moving surface of the transport element.

12 Claims, 2 Drawing Sheets

DEVICE ON A SPINNING PREPARATION MACHINE, FOR EXAMPLE A TUFT FEEDER, HAVING A FEED DEVICE

CROSS REFERENCE TO RELATED APPLICATION

This application claims priority from German Patent Application No. 10 2004 012 236.9 dated Mar. 12, 2004, the entire disclosure of which is incorporated herein by reference.

BACKGROUND OF THE INVENTION

The invention relates to a device on a spinning preparation machine, for example a tuft feeder, having a feed device comprising at least one slow-speed feed roller and a counter-element, for example a feed tray, with which fibre material can be supplied to a downstream transport device having a driven transport element, for example a conveyor belt.

In systems for the volumetric scanning of fibre streams, friction inevitably arises. When there is a continuous stream of fibre material, such friction results in compaction of the fibre material in the direction of flow. Once the fibre stream has emerged from the gap of the roller/tray system, the tension on the fibre material is relaxed and the fibre material assumes a higher exit speed relative to the circumferential speed of the feed roller. Particularly in the case of slow throughflow speeds, there is considerably more time available until the next working step, which inevitably also results in a greater relaxation of the tension on the fibre material. In practice, when the system settings are designed for high throughflow speeds, the emerging fibre mat is thrown upwards in the start-up phase, which generally leads to faults occurring in the subsequent working step.

It is an aim of the invention to provide a device of the kind described at the beginning which avoids or mitigates the mentioned disadvantages, which especially allows improved delivery from the feed device, or improved takeover by the downstream transport device, and allows troublefree operation.

SUMMARY OF THE INVENTION

The invention provides a feed arrangement for a spinning preparation machine, comprising:

a feed device comprising a feed roller, a counter-element and a speed-measurement device for measuring the speed of the feed roller;

a driven transport device having a driven transport element arranged to receive fibre material from the feed device and further comprising a measuring device for measuring the speed of the transport device; and a control device;

wherein the control device is arranged to determine a relationship between measured values of the speed of the feed roller and measured values of the speed of the transport device relative to time, and in dependence thereon to determine values for the optimum speed of the transport device.

Because the appropriate belt speed is generated and set for every throughflow speed of the fibre material through the roller/tray system, the fibre material is prevented from being thrown upwards above the transport device. The fibre material lies on the moving surface of the transport element. In this way, troublefree operation and an evening-out of the fibre material transport and of the fibre material are achieved.

The arrangement may be such that the feed roller speed and the transport speed can be set manually. The arrangement may be such that the feed roller speed and the transport element speed can instead be set automatically. The surface of the transport element may be associated with a distance-measuring device for the fibre material, for example an optical distance-measuring device is used. The distance-measuring means may comprise CCD elements. The height-measuring device may be able to determine lifting-away of the fibre material from the surface of the transport element. Advantageously, the function can be entered into an electronic memory. There may be provided an electrical regulating and control device to which a measuring element for the feed roller speed and a measuring element for the transport element speed are connected. The distance-measuring device may be connected to the electrical regulating and control device. The electrical memory may be connected to the electrical regulating and controlling device.

The invention also provides a device on a spinning preparation machine, for example a tuft feeder, having a feed device comprising at least one slow-speed feed roller and a counter-element, for example a feed tray, with which fibre material can be supplied to a downstream transport device having a driven transport element, for example a conveyor belt, wherein to determine setting values for the optimum speed of the transport device a function between the measured values of the speed of the feed roller and the measured values of the speed of the transport device relative to time is so determined that the fibre material lies on the moving surface of the transport device.

DESCRIPTION OF PREFERRED EMBODIMENTS

Figure 1:
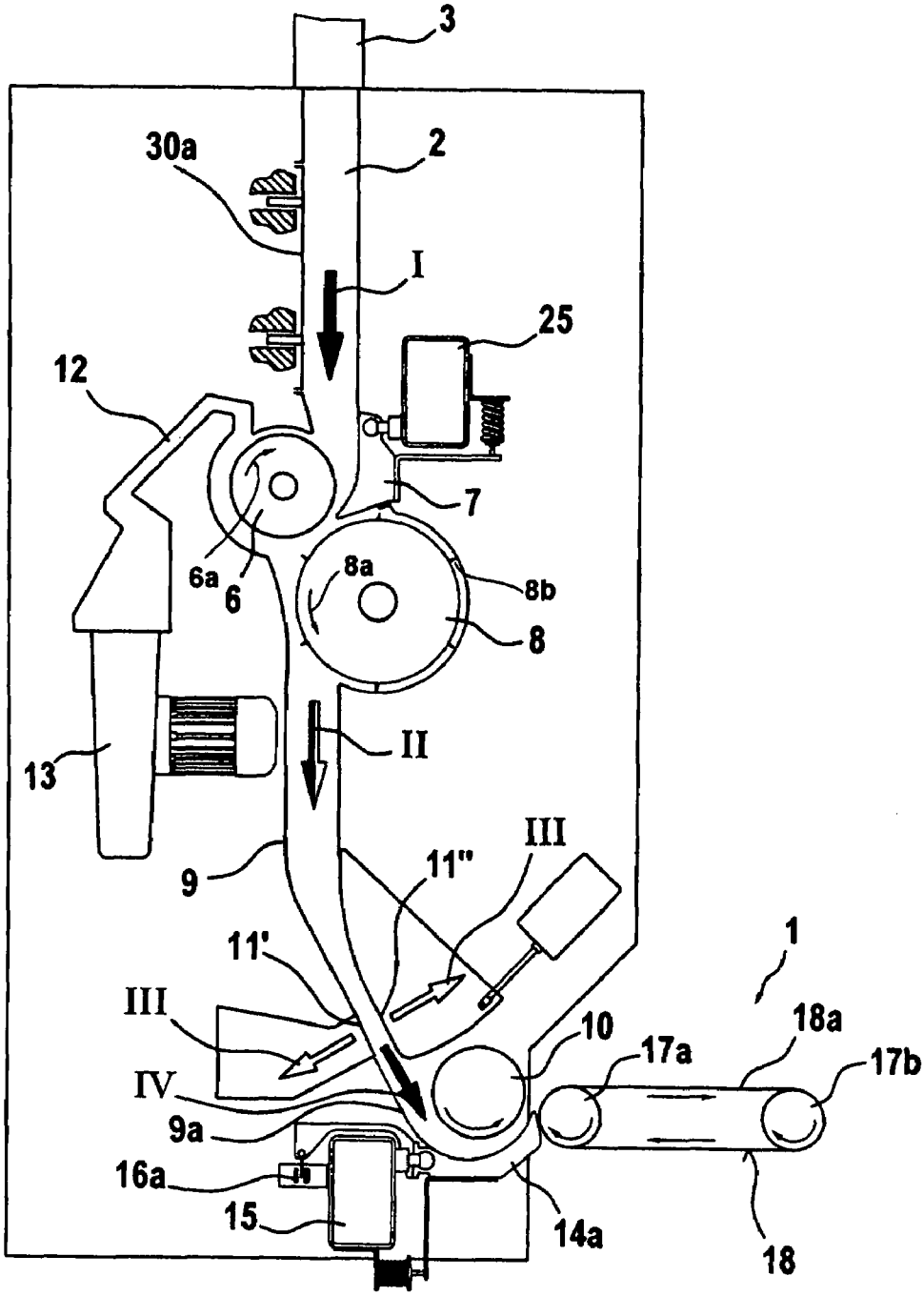
FIG. 1 is a diagrammatic side view of a device according to the invention on a tuft feeder and downstream conveyor belt.

Referring to FIG. 1, upstream of a continuously circulating conveyor belt 1 there is provided a vertical reserve chute 2 which is charged from above with finely opened fibre material. Charging can be effected, for example, by means of a condenser through a supply and distributor line 3. In the upper region of the reserve chute 2 there are air outlet openings through which the transport air, after being separated from the fibre flocks I, passes into an extractor device. The lower end of the reserve chute 2 is closed by an intake roller 6 which cooperates with an intake tray 7. By means of this slow-speed feed roller 6, the fibre material is supplied from the reserve chute 2 to a high-speed opener roller 8 that is located below the reserve chute and is covered with pins 8*b* or sawtooth wire, which opener roller 8 is associated over a portion of its circumference with a lower feed chute 9. The opener roller 8, which rotates in the direction of arrow 8*a*, transports the fibre material II that it collects into the feed chute 9. The feed chute 9 has at its lower end a feed roller 10 (delivery roller) rotating in accordance with the arrow drawn inside it, which supplies the fibre material to the conveyor belt 1. This tuft feeder can be, for example, a SCANFEED TF tuft feeder from the Trutzschler company, Monchengladbach, Germany. The intake roller 6 rotates slowly clockwise (arrow 6*a*) and the opener roller 8 rotates counterclockwise (arrow 8*b*), so that an opposed direction of rotation is achieved. The walls of the feed chute 9 are in the lower portion provided with air outlet openings 11', 11" up to a certain height. At the top, the feed chute 9 communicates with a box-shaped chamber 12, to one end of which there is connected the outlet of a fan 13 (see FIG. 1). By means of the rotating intake roller 6 and the rotating opener roller 8, a certain amount of fibre material II per unit of time is continuously fed into the feed chute 9 and the same amount of fibre material is supplied to the conveyor belt 1, the fibre material being conveyed out of the feed chute 9 by the feed roller 10 which cooperates with a feed tray 14 comprising a plurality of individual trays 14*a* to 14*n*. In order that this amount of material is compacted uniformly and kept constant, the fibre material in the feed chute 9 is acted upon by throughflowing air by means of the fan 13 via the box-shaped chamber 12. Air is drawn into the fan 13 and passed through the fibre mass located in the feed chute 9, the air III then leaving through the air outlet openings 11', 11" at the lower end of the feed chute 9. The lower end of the wall 9*a* of the feed chute 9 is associated with a support 15 (cross-beam), for example of structural steel, on which the feed trays 14*a* to 14*n* are pivotally mounted across its width. Each feed tray 14*a* to 14*n* (only 14*a* shown) is associated with an inductive displacement sensor 16*a* to 16*n* (only 16*a* shown).

The conveyor belt 1 has two guide rollers 17*a*, 17*b* around which a continuously circulating belt 18 revolves. The guide roller 17*a* is arranged immediately adjacent to the end of the transport gap between the feed roller 10 and the feed trays 14*a* to 14*n*. The directions of rotation of the rollers are indicated by curved arrows.

Figure 2:
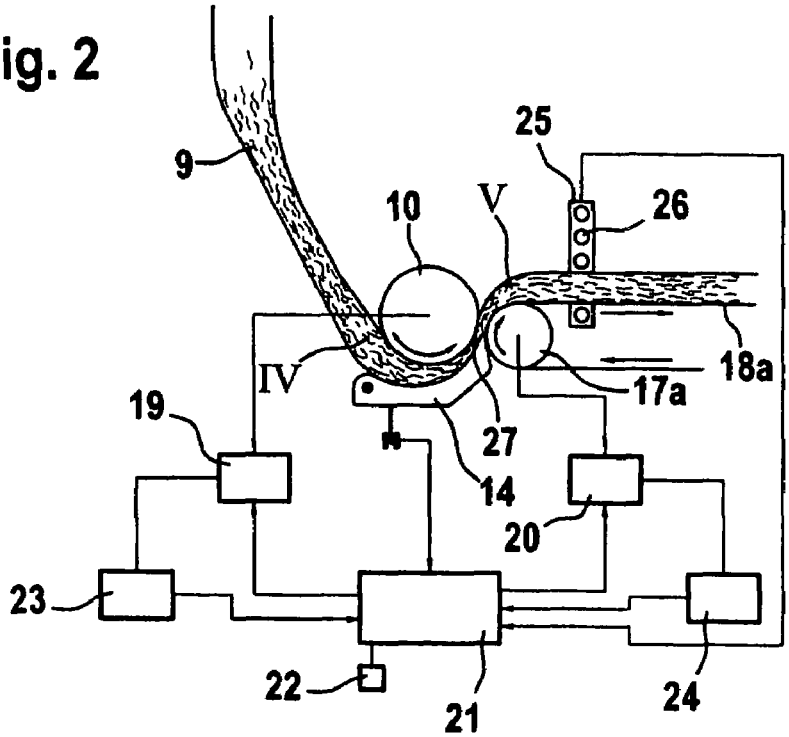
FIG. 2 shows the feed device of a tuft feeder, a portion of a conveyor belt immediately downstream of the feed device, the fibre material and a block diagram for determining optimum speeds.

In the embodiment of FIG. 2, the feed roller 10 is driven by a slow-speed electric drive motor 19 and the guide roller 17*a* of the conveyor belt 1 is driven by a slow-speed electric drive motor 20. The drive motors 19 and 20 are connected to an electronic controlling and regulating device 21 which has a memory element 22. The drive motor 19 and the drive motor 20 are each associated with a respective speed measuring element 23, 24, for example tachogenerators, which are connected to the controlling and regulating device 21.

Associated with the upper horizontal belt section 18*a* in the vertical direction as a height-measuring device there is a light strip 25 having a plurality of photo-electric elements 26 which are likewise connected to the controlling and regulating device 21.

A regulating circuit influences the transport of fibre material from the feed device of the tuft feeder, consisting of feed roller 10 and feed tray 14, to the downstream conveyor belt 1. This FEEDCONTROL (trade mark) system supplies the conveyor belt 1 continuously with the same amount of fibre material and regulates any remaining fluctuations in the fibre material which are transmitted by way of the inductive displacement sensors 16*a* to 16*n* in signal form to the controlling and regulating device 21.

For the fibre stream IV entering the measurement region 27 between roller 10 and scanning tray 14, it is necessary for the measuring operation that compaction is effected perpendicular to the fibre stream IV. In addition to that compaction acting perpendicular to the direction of flow, as a result of the friction between the material and the scanning tray 14 the fibre stream IV is also subject to compaction acting in the direction of flow. After the fibre stream has emerged from the roller/tray system, the tension on the material is relaxed and the material assumes an exit speed that is higher relative to the circumferential speed of the feed roller 10 (transport roller). The magnitude of this exit speed is dependent upon the recovery capacity of the fibre material and upon the average throughflow speed in the entire system. According to the invention, the belt speed of the conveyor belt 1 is matched to those conditions.

Figure 3:
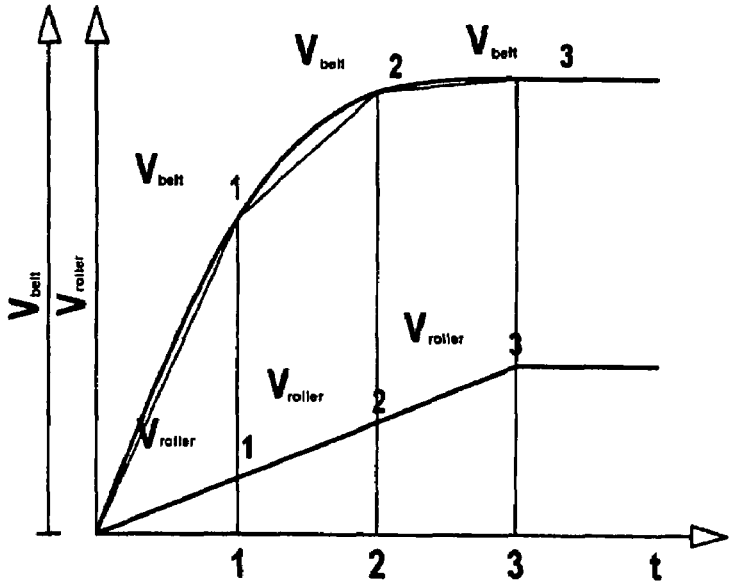
FIG. 3 is a graph showing belt speed and feed roller speed as a function of time.

During the run-up phase, a different, appropriate belt speed is set for each roller speed, the real setting values also varying from material to material. In the course of setting up for a certain material, starting from stationary, the rollers are run at different speeds and the belt speed appropriate for each roller speed is set manually. Once the belt speed to be assigned to a roller speed (without the web being thrown upwards) has been found, that setting is transmitted to the controlling means (acknowledgement of the found values). This operation is repeated, with the roller speed increasing, as many times as is necessary until a sufficient number of data points has been found (teach-in process). Once those data have been stored in the memory element 22 (batch memory), the belt speed $V_{belt}$ (see FIG. 3) appropriate to each throughflow speed $V_{roller}$ can be set automatically by the machine controlling device 21.

In order to determine setting values for the optimum speed of the transport device 1, for example a conveyor belt, a function between the measured values of the speed of the feed roller 10 and the measured values of the speed of the belt guide roller 17*a* relative to time t is so determined that the fibre material V lies on the surface of the upper belt section 18*a* and does not lift away from the upper belt section 18*a* (so-called throwing-upwards of the fibre material).

As FIG. 2 shows, the upper belt section 18*a* is on one side associated with a light strip 25 having photoelectric elements 26, light barriers or the like. The light strip 25 sends electrical signals to the controlling and regulating device 21 which indicate whether the fibre material V is lying on or lifting away from the upper belt section 18*a*. In this way, setting values for the optimum speed of the transport device 1 can be determined automatically and entered into the memory 22.

As fibre processing devices it is possible for the tuft feeder SCANFEED TF to be followed by a carding machine, an aerodynamic web former, a needling machine, a thermofusion device or a spun-lace device.

Although the foregoing invention has been described in detail by way of illustration and example for purposes of understanding, it will be obvious that changes and modifications may be practiced within the scope of the appended claims.

What is claimed is:

1. A feed arrangement for a spinning preparation machine, comprising:

a feed device comprising a feed roller, a counter-element, and a speed-measurement device for measuring the speed of the feed roller;

a driven transport device having a driven transport belt arranged to receive fibre material from the feed device, and further comprising a measuring device for measuring the speed of the transport device; and a control device;

wherein the control device is adapted to adjust the speed of the transport device in relation to the speed of the feed roller in order to prevent the fibre material received by the transport belt from lifting off of the transport belt.

2. A feed arrangement according to claim 1, further comprising a memory storing a first multiplicity of data points relating to the speed of the roller, and a second multiplicity of data points relating to corresponding speeds of the transport element at which the fibre material does not lift off of the transport belt.

3. A feed arrangement according to claim 1, in which the feed roller speed and the transport element speed can be set manually.

4. A feed arrangement according to claim 1, in which the feed roller speed and the transport element speed can be set automatically.

5. A feed arrangement according to claim 1, further comprising a distance-measuring device associated with the surface of the transport belt, the distance-measuring device adapted to measure whether the fibre material has lifted off of the transport belt.

6. A feed arrangement according to claim 5, wherein the distance-measuring device comprises an optical distance-measuring device.

7. A feed arrangement according to claim 5, wherein the distance-measuring device comprises CCD elements.

8. A feed arrangement according to claim 2, wherein the memory stores a mathematical equation corresponding to the relationship between the first multiplicity of data points and the second multiplicity of data points.

9. A feed arrangement for a spinning preparation machine, comprising:

a feed device comprising a slow rotating feed roller and a counter-element, the speed of the feed roller being adjustable;

a transport device comprising a moving transport belt, the speed of the transport device being adjustable; and a control device for determining and setting optimum speed values for the transport element with respect to the speed value of the feed roller, wherein the control device determines and stores for each of a plurality of feed roller speeds, a corresponding transport element speed that permits delivery of fibre material onto the transport belt by the feed device in such a manner that the fibre material does not lift away from the transport belt.

10. A feed arrangement according to claim 9, comprising:

a control device;

a measuring element for the roller speed; and a measuring element for the transport element speed;

the roller speed measuring element and the transport element speed measuring element being connected to the control device.

11. A feed arrangement according to claim 10, further comprising a distance-measuring device connected to the control device, the distance-measuring device being arranged for determining whether fibre material has lifted from the transport belt.

12. A device on a spinning preparation machine comprising:

a feed device comprising at least one slow-speed feed roller and a counter-element with which fibre material can be supplied to a downstream transport device having a driven transport belt; and a control device adapted to determine values for the optimum speed of the transport device as a function of given measured values of the speed of the feed roller wherein when the transport device operates at the optimum speed with respect to the given speed of the feed roller, the fibre material lies on the transport belt and does not lift up from the transport belt.

* * * * *